US006253682B1

(12) United States Patent
Saxby

(10) Patent No.: US 6,253,682 B1
(45) Date of Patent: Jul. 3, 2001

(54) RELATING TO PYROTECHNIC AMMUNITION

(76) Inventor: Michael Ernest Saxby, Summerleas, Peartree Lane, Bexhill on Sea, East Sussex TN39 5JN (GB)

( * ) Notice: Subject to any disclaimer, the term of this patent is extended or adjusted under 35 U.S.C. 154(b) by 0 days.

(21) Appl. No.: 09/381,115

(22) PCT Filed: Mar. 13, 1998

(86) PCT No.: PCT/GB98/00620

§ 371 Date: Feb. 2, 2000

§ 102(e) Date: Feb. 2, 2000

(87) PCT Pub. No.: WO98/41810

PCT Pub. Date: Sep. 24, 1998

(30) Foreign Application Priority Data

Mar. 14, 1997 (GB) ..... 9705363

(51) Int. Cl.[7] ..... F42B 8/00
(52) U.S. Cl. ..... 102/444; 102/430
(58) Field of Search ..... 102/430, 439, 102/440, 444, 446, 447

(56) References Cited

U.S. PATENT DOCUMENTS

| | | | |
|---|---|---|---|
| 3,477,375 | 11/1969 | Barr . | |
| 3,528,662 | 9/1970 | Merchant et al. | 273/106.5 |
| 3,782,286 | 1/1974 | Jones et al. | 102/41 |
| 3,837,284 | 9/1974 | Waldeisen | 102/92 |
| 3,952,662 | 4/1976 | Greenlees | 102/92.7 |
| 4,128,059 | 12/1978 | Black | 102/92.7 |
| 4,204,474 | 5/1980 | Mizelle | 102/92.7 |
| 4,637,616 | 1/1987 | Whiting | 273/418 |
| 4,686,905 | 8/1987 | Szabo . | |
| 4,823,702 | 4/1989 | Woolsey | 102/502 |

FOREIGN PATENT DOCUMENTS

| | | | |
|---|---|---|---|
| 553823 * | 6/1943 | (GB) | 102/444 |
| 1263522 | 2/1972 | (GB) . | |
| 1309362 | 3/1973 | (GB) . | |
| 1371482 | 10/1974 | (GB) . | |
| 2 284 252 | 5/1995 | (GB) . | |
| WO 91/14916 | 10/1991 | (WO) . | |
| WO 95/05573 | 2/1995 | (WO) . | |

* cited by examiner

*Primary Examiner*—Harold J. Tudor
(74) *Attorney, Agent, or Firm*—Lahive & Cockfield, LLP

(57) ABSTRACT

A cartridge comprising a casing (1) having a passage extending therethrough, said passage having a larger diameter rearward section (7) and a smaller diameter forward section (9). A core member is slidably received in the passage, and has a forwardly facing piston surface (21) and a portion (19) closing the forward length of passage in the unactivated condition of the cartridge. A cavity (23) within the core member receives propellant gas from a primer (25) and discharges the gas into the passage forwardly of the piston surface. The core is propelled rearwardly and releases propellant gas into the forward passage section.

5 Claims, 1 Drawing Sheet

RELATING TO PYROTECHNIC AMMUNITION

WO 95/05573 relates to a gas cartridge which can be used as an alternative to cartridges activated by pyrotechnic mechanisms. U.S. Pat. No. 4,686,905 relates to a pyrotechic cartridge for a frangible projectile.

European patent specification EP 473 758 relates to non-lethal pyrotechnic ammunition for training and war games. A cartridge disclosed in this earlier specification includes a casing slidable relative to a plug at the forward end of the cartridge. When the cartridge is fired, force provided by the propellant gas is employed to urge the casing back against the breech-block and recycle the weapon.

This known cartridge is charged with a small quantity of propellant in addition to that contained in a primer. In order to achieve the objective of the cartridge, the propellant gas is fed through relatively constricted passages and galleries. Filling and machining tolerances mean that variations often occur in the weight of the additional propellant, and in flow rates through the passages and galleries, and lead to unreliable performance.

Figure 1:
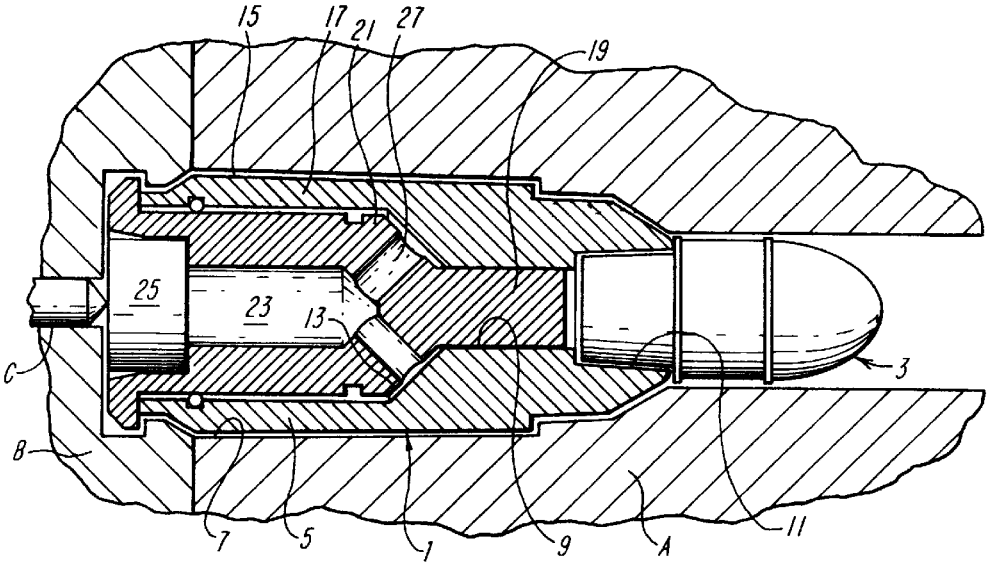
Figure 2:
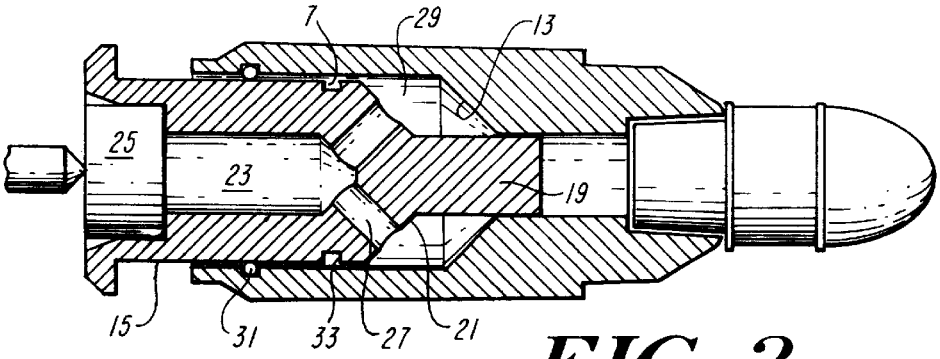
Figure 3:
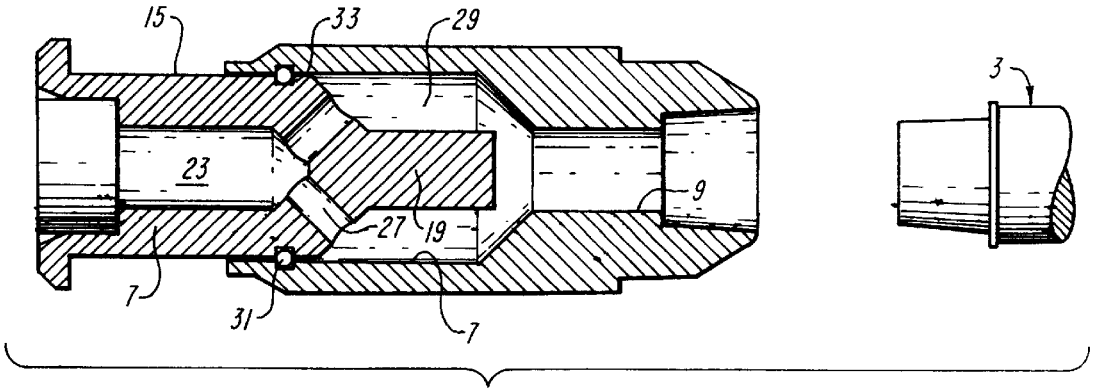

This problem is overcome by the cartridge herein proposed, which will now be described with reference to the accompanying drawings, in which:

FIG. 1 is an axial section through a round of ammunition which incorporates the proposed cartridge, showing the round in position within the barrel of a gun, before firing, FIG. 2 is a view similar to FIG. 1, showing the parts of the cartridge in the positions they occupy immediately after ignition of the primer, FIG. 3 is a view similar to FIG. 1, showing the parts of the cartridge in the positions they occupy immediately after the ejection of the projectile.

Referring to FIG. 1 of the drawing, a round of ammunition includes a cartridge 1 and a projectile 3 in the form of a taper lock bullet. The round is depicted in the chamber of a firearm having a barrel A, breech block B and firing pin C, all shown schematically.

The cartridge includes a casing 5 having an external shape which conforms to the chamber. The casing is in the form of a hollow component through which extends a passage of circular cross-section having a large diameter rearward section 7, a narrowed intermediate section 9, and a tapered forward section 11 which receives the trailing end of the projectile. A frustoconical transition surface 13 extends between the passage sections 7 and 9.

Inserted into the casing 5 from its rear end is a core 15 having a hollow rearward portion 17 and a solid forward portion 19 joined by an intermediate portion 21. The portions 17 and 19 are shaped externally so as to be a sliding fit in the passage sections 7 and 9 and the intermediate portion 21 is complementary to the transition surface 13. The portion 19 serves substantially to block the passage section 9 against escape of gas therethrough.

Within the rearward body portion 17 of the core is a chamber 23 which is enlarged at is rearward end to receive an explosive primer 25. Passing through the intermediate body portion 21 is a plurality of obliquely outwardly radiating bores 27, conveniently three or four in number. The outer ends of the bores 27 face the transition surface 13.

The chamber 23 serves as, and will be referred to herein as, the first expansion chamber.

When the firearm is fired, the firing pin C strikes the primer 25, which explodes and discharges propellant gas into the first expansion chamber 23. The gas passes through the passages 27 into the space defined between the intermediate portion 21 and transition surface 13 of the bore. The outer surface of the intermediate portion 21 serves as a piston, so that the gas forces the core 5 towards the rear, to create a second expansion chamber 29, as shown in FIG. 2. During this action, the forward core portion 19 is withdrawn through the passage section 7. Rearward movement of the core 15 ceases when a retaining and seal ring 31 at the rear of the passage section 7 engages a stop surface 33 at the forward end of the rearward body portion 17, as shown in FIG. 3. Contact between the seal ring and the surface of the rearward body portion 17 prevents escape of gas to the rear during the operation of the cartridge described above. During this sequence of operations, upon complete withdrawal of the forward core part 19 from the forward passage section 11, the gas in the second expansion chamber 29 is dumped instantaneously into the passage sections 9 and 11 to expel the projectile.

The rearward movement of the core applies force to the breech block to recycle the weapon.

Because the operation of the proposed cartridge does not depend upon the use of propellant additional to that provided by primer 25, and ejection of the projectile takes place in response to the opening of passage section 9 and substantially instantaneous dumping of gas into that passage, the proposed cartridge does not suffer from the tendency towards unreliable operation which characterises the cartridge known from EP 473 758.

Because the proposed cartridge does not have the fine passages of the known cartridge, at least the core is especially suited to moulding from plastics.

The cartridge may also be reused by replacing the primer or, alternatively, replacing the core and primer assembly. The proposed cartridge is also less toxic than the known cartridge because no additional propellant is required.

The cartridge may be used as a blank if the projectile is omitted.

Although the transition surface is shown to be frustoconical, and the outer surface of the intermediate portion 21 complementary thereto, it is possible for and least the outer surface of the intermediate portion 21 to extend radially, provided that bores 27 are suitably arranged to feed gas into the second expansion chamber

What is claimed is:

1. A cartridge for use in a firearm, said cartridge being capable on firing of recycling the firearm; the cartridge comprising a casing having a projectile mounted in a front end thereof so as to extend forwardly therefrom, the casing being formed with a stepped passage therethrough, the passage having a rearward larger diameter section, a narrower intermediate section and a tapered forward section which receives a trailing end of the projectile;

a core member disposed in the stepped passage, the core member having a peripheral flange at a rearward end thereof, which flange extends rearwardly of the casing, and a forward facing piston surface and a forward portion; the forward portion of the core member being slidably received in and blocking the narrower intermediate section in an inactivated condition of the cartridge;

the core member having a defined therein a first expansion chamber to receive propellant gas from a primer, at least one outlet opening from said chamber through said forward facing piston surface into the passage rearwardly of a step between the rearward larger diameter section and the narrower intermediate section to allow gas to flow from the first expansion chamber into a second expansion chamber defined between the core member and the passage rearwardly of the step;

such that on actuation of the primer, propellant gas is released into the first expansion chamber and then the second expansion chamber, wherein the second expansion chamber expands and propels the core member rearwardly to move the forward portion to unblock the narrower intermediate section and to allow gas to flow therethrough to eject the projectile from the tapered forward section of the passage, and wherein propulsion of the core member rearwardly serves to recycle the firearm.

2. A cartridge as claimed in claim 1, wherein the forward facing piston surface is frustoconical.

3. A cartridge as claimed in claim 1, wherein the forward facing piston surface extends radially.

4. A cartridge as claimed in claim 1, wherein the casing comprises a retaining and sealing ring.

5. A cartridge as claimed in claim 1, wherein the projectile is a taper lock bullet.

* * * * *